United States Patent [19]

Grossi et al.

[11] 4,087,781

[45] May 2, 1978

[54] ELECTROMAGNETIC LITHOSPHERE TELEMETRY SYSTEM

[75] Inventors: Mario D. Grossi, Cambridge; Robert K. Cross, Needham, both of Mass.

[73] Assignee: Raytheon Company, Lexington, Mass.

[21] Appl. No.: 682,417

[22] Filed: May 3, 1976

Related U.S. Application Data

[63] Continuation of Ser. No. 484,638, Jul. 1, 1974, abandoned.

[51] Int. Cl.[2] ..... G01V 1/40

[52] U.S. Cl. ..... 340/18 NC; 325/6; 325/28; 340/18 LD

[58] Field of Search ..... 340/18 NC, 18 LD; 325/6, 28; 324/5, 6

[56] References Cited

U.S. PATENT DOCUMENTS

| | | | |
|---|---|---|---|
| 1,926,327 | 9/1933 | Burrell et al. | 325/28 |
| 2,411,696 | 11/1946 | Silverman et al. | 340/18 NC |
| 2,992,325 | 7/1961 | Lehan | 325/28 |
| 2,998,516 | 8/1961 | Lehan et al. | 325/28 |
| 3,046,474 | 7/1962 | Arps | 340/18 NC |
| 3,150,321 | 9/1964 | Summers | 340/18 NC |
| 3,186,222 | 6/1965 | Martin | 340/18 NC |
| 3,315,224 | 4/1967 | Ferguson | 340/18 NC |
| 3,763,419 | 10/1973 | Barringer | 324/6 |
| 3,821,696 | 6/1974 | Harrell et al. | 340/18 LD |
| 3,967,201 | 6/1976 | Rorden | 325/28 |

OTHER PUBLICATIONS

"Borehole Telemetry System is Key to Continuous Downhole Drilling Measurements", McDonald and Ward, *The Oil and Gas Journal*, Sep. 15, 1975, pp. 111–118.

*Primary Examiner*—Howard A. Birmiel
*Attorney, Agent, or Firm*—John R. Inge; Milton D. Bartlett; Joseph D. Pannone

[57] ABSTRACT

A lithospheric electromagnetic telemetry system specifically adapted for telemetry of oil well drilling parameters from well bottom to surface of the earth. Sensors measure such parameters as pressure, temperature, salinity, direction of well bore, bit conditions, as well as the standard well logging parameters. The sensor outputs are converted to digital form and stored in a local memory until they are transmitted upon a triggering signal from a surface station. Transmission is accomplished by phase shift modulating an ELF (Extra Low Frequency) or ULF (Ultra Low Frequency) carrier, preferably in the range of 1–30 Hz. Repeater stations which delay and retransmit the signal are spaced along the oil well drill pipe as required. Both the well bottom station and repeaters are mounted inside the oil well drill pipe without substantially decreasing clearance for mud flow.

16 Claims, 5 Drawing Figures

ELECTROMAGNETIC LITHOSPHERE TELEMETRY SYSTEM

CROSS-REFERENCE TO RELATED CASES

This is a continuation of application Ser. No. 484,638, filed July 1, 1974, now abandoned.

BACKGROUND OF THE INVENTION

1. Field of the Invention

The invention relates to telemetry of information through the earth's lithosphere. It is particularly adapted for telemetry of information from the bottom of an oil well to the surface of the earth during oil well drilling operations. The information telemetered may include but is not limited to the parameters of pressure, temperature, salinity, direction and deviation of the well bore, bit conditions, and logging data including resistivity of the various layers, sonic density, porosity, induction, self potential, and pressure gradients.

2. Description on the Prior Art

In previous oil well telemetry systems when it was desired to make measurements of important parameters at the bottom of the oil well, it was first necessary to pull up the drilling pipe section by section including the drilling bit to completely vacate the drilled hole. Sensors were then lowered down to the bottom of the well on a connected wire, the measurements were taken, the sensors and wire removed, and finally the bit and drilling pipe reassembled and put back into the hole. Obviously, such procedures were extremely expensive and time consuming since drilling operations had to be ceased each time measurements were to be made.

These problems have led to numerous attempts at oil well telemetry in which the drilling pipe and bit do not have to be removed from the well before measurements are made. Attempts have been made to telemeter data by means of sonic waves traveling through either the drilling pipe or through the drilling mud present both inside and surrounding the drilling pipe. Unfortunately, the drilling mud proved to be a strong sonic damper which destroyed the sonic waves before they could travel very far. Total depth attainable for telemetry with such systems was much smaller than minimally needed in a practical system.

Further attempts included installing a bifilar electric line either inside or outside of the drilling pipe or the casing pipe. Unfortunately, the mechanical stresses inside the well and the rocks and other debris brought up from the bottom of the well frequently destroyed the wire.

Another attempted system included a conductor inside of each section of drill pipe with transformer coupling between sections of pipe. Besides requiring expensive modifications to the drill pipe these systems proved unreliable in that magnetic coupling between sections was frequently hindered by mechanical misalignment between drill pipe sections and because of the attendant difficulty of aligning coupling coils with one another.

Still further attempts included one in which either the drilling pipe or casing pipe was used as one of the conductors in an electrical transmission system. In one such system, the earth itself formed the other conductor. Unfortunately, the conductivity of the earth is unpredictable and is frequently too low to make such a system practical at typical oil well depths. Still further such systems included a single wire along the casing pipe or drilling pipe. Such systems suffered from the problems discussed above with the bifilar type wire system. Both types of such systems suffered the additional common problem that the conductivity between pipe sections is greatly affected by the presence of contaminants on the pipe joints. Frequently the resistance of the pipe joints was too high to permit telemetry using any practical power levels.

SUMMARY OF THE INVENTION

Accordingly, it is an object of the present invention to provide an oil well telemetry system in which the drilling pipe and drilling bit need not be removed from the oil well each time parameter measurements are to be made.

Furthermore, it is an object of the present invention to provide a system in which telemetry from the bottom of an oil well can be accomplished reliably unaffected by the resistance of the drilling pipe and casing pipe.

Moreover, it is an object of the present invention to provide an oil well telemetry system which operates within a wide range of values of the resistivity of the various layers of earth through which the oil well is bored.

Also, it is an object of the present invention to provide an oil well telemetry system which does not require modifications to every section of drilling pipe.

These as well as other objects may be met by a telemetry system in which the relevant parameters are measured by sensors located in the vicinity of the drill bit in a well bottom telemetry station. The outputs of the sensors are digitized and stored until transmission is triggered by a signal arriving via lithospheric propagation from a surface station. Transmission from well bottom to surface of telemetry data is normally performed during the pauses of the drilling string rotation. However, selected narrow-band emergency messages such as "Alarm of impending blow-out" can be automatically transmitted from the well bottom without the need of a triggering signal from the surface station, and while full rotation of the drilling string is underway. Transmission uses an ELF (3–3000 *Hz*) or ULF (0.03–3 Hz) carrier, preferably in the range of 1–30 Hz.

Phase shift modulation is preferred. The electromagnetic carrier propagates via lithospheric paths. Repeater stations are located along the length of the drill pipe as required. In a preferred embodiment, 1 kilometer spacing is used between stations. At each repeater station there is located a transceiver including a transmitter and receiver operating preferably upon the same frequency as the well bottom station transmitter.

The signal to be relayed by the repeater station is received, delayed by one or more bit time periods to prevent regeneration with the well bottom station and other repeater stations. The signal is retransmitted upon the same frequency.

In the preferred embodiment, the well bottom and repeater stations are located in specially modified drill pipe sections which mechanically couple to the other drill pipe sections without special modifications to the other drill pipe sections. Also in the preferred embodiment, antennas preferably with high permeability core are used for both transmitting and receiving. These are also located inside the special drilling pipe sections.

DESCRIPTION OF THE PREFERRED EMBODIMENT

Figure 1:
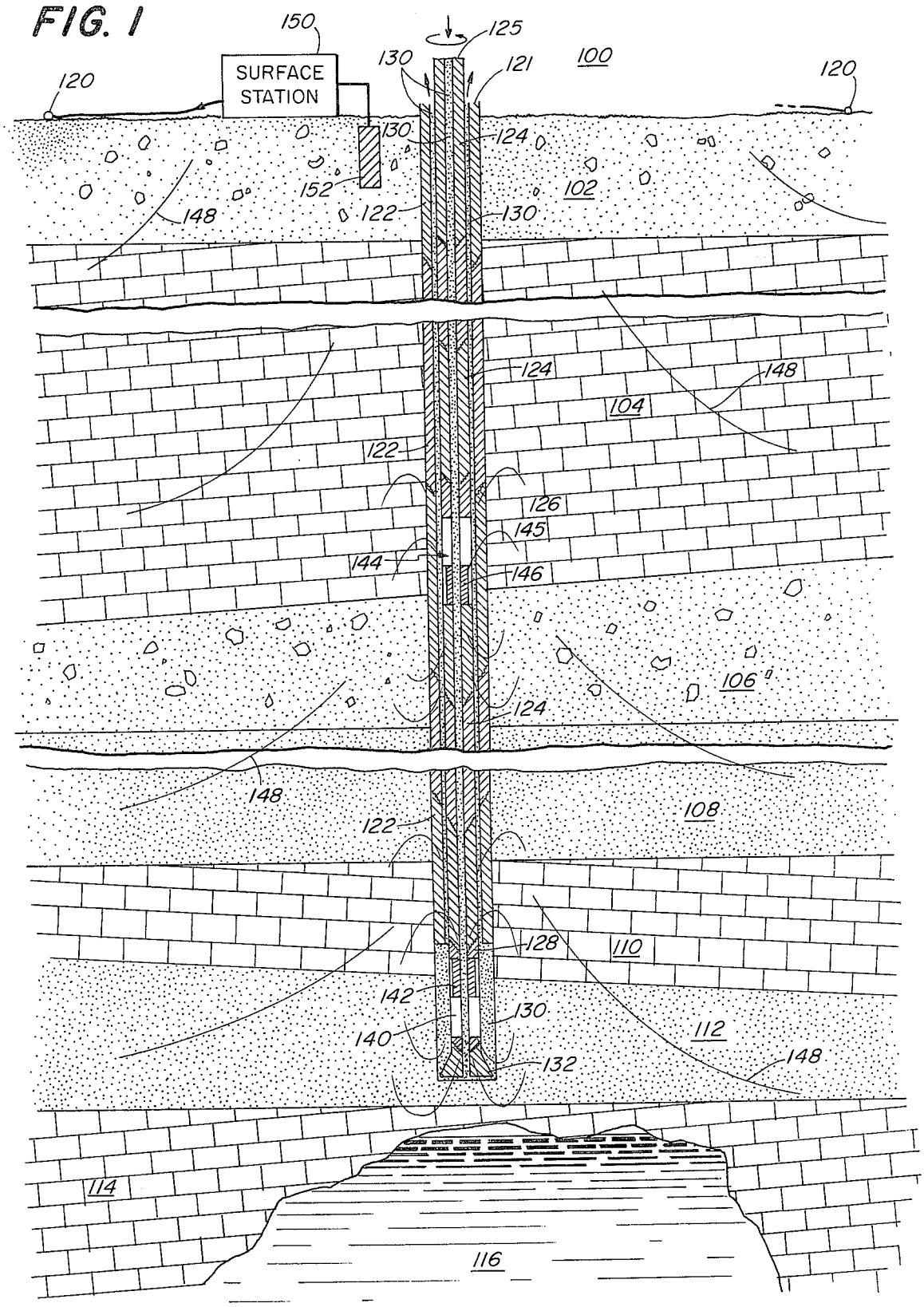
FIG. 1 is a cross-sectional view of an oil well embodying a telemetry system in accordance with the present invention.

In FIG. 1 is shown a cross-sectional view of an oil well and surrounding lithospheric layers through which oil well 100 is drilled. Oil well 100 may pass, for example, through top soil layer 102, first shale layer 104, gravel layer 106, first sand layer 108, second shale layer 110, and second sand layer 112. Oil well pool 116 towards which oil well 100 is aimed is located beneath third shale layer 114.

The actual drilling is performed by drill bit 132 located at the end of drilling pipe assembly 125. Drilling pipe assembly 125 is made up of numerous drilling pipe sections 124 which are screwed together with tool joints and assembled one-by-one as the oil well progresses downward.

Casing pipe assembly 121 is used to keep the surrounding layers from caving into the oil well hole and to prevent unwanted water and other fluids from entering the well. Casing pipe assembly 121 is made up of individual casing sections 122 which are screwed together and pushed downward surrounding drilling pipe assembly 125. Both casing sections 122 and drilling pipe sections 124 are made of high strength steel. The same type of casing sections and drilling pipe sections are used with the present invention as have previously been used. No modifications are required for the present invention to function properly.

Drilling mud from an external supply, not shown, is forced downward through the hole in the center of drilling pipe assembly 125 to the bottom of the oil well and to the region surrounding drilling bit 132. Drilling mud 130 lubricates drilling bit 132 and conveys drilled away debris upwards to the surface in the space between drilling pipe assembly 125 and casing pipe assembly 121. Depending upon the types of formatons encountered, different types of drilling mud are used. In some oil well situations it has been found advantageous to employ water rather than mud.

At the bottom of oil well 100 in the drilling pipe section attached to drilling bit 132 is located well-bottom station 140 including therein parameter sensors, digitizing circuitry, and telemetry transmitter. There is one sensor present in well bottom station 140 for each parameter to be measured. These parameters include but are not limited to pressure, temperature, salinity, direction and deviation of well bore, bit conditions and logging data including resistivity, sonic density, porosity, induction, self potential and pressure gradients. With knowledge of these parameters one skilled in the art is able to make numerous determinations about the oil well. These include the speed at which the well should be drilled, the type of drilling mud to be employed, the length of time remaining before the drilling bit needs to be changed, the direction at which the well is being drilled, as well as the present likelihood of striking oil as indicated by the parameters of the surrounding substrates. Moreover, the speed at which these parameters are obtained is a large factor in determining the overall cost of the drilling of the oil well. It will be demonstrated that with the present invention the speed at which these parameters may be obtained by one on the surface is much faster than has hitherto been obtainable with prior art telemetry systems.

When it is desired to initiate transmission of data from the bottom of oil well 100, a triggering signal is transmitted to the bottom of oil well 100 and received at well bottom station 140 through antenna 142. To transmit the triggering signal a single turn loop 120 surrounding oil well 100 is activated with a signal in the ELF/ULF range of 1–30 Hz. The activating signal is produced at surface station 150. The activation of single turn loop 120 produces an electromagnetic field as indicated by field lines 148. The triggering signal reaches the bottom of oil well 100 without amplification by intervening repeater stations because of the relative ease in obtaining higher power levels on the surface and because the level of noise present in the lithosphere generally decreases with depth in the earth.

Upon reception of the triggering signal transmitted from the surface, the stored digitized sensor outputs are transmitted upon a ELF/ULF carrier in the range of 1–30 Hz. The sensor data is transmitted one bit at a time in serial fashion. For example, if the output of one of the sensors in digital form is made up of six bits, those six bits are transmitted one at a time until all six have been transmitted. Phase shift modulation is preferred although other types of modulation may be used as well.

An identifying code can be transmitted before the start of data transmission from each of the sensors to indicate which of the parameters is then being transmitted. Alternatively, it is possible to encode the triggering signal from the surface so that only a specific one or group of the stored parameters is transmitted for the particular code then present upon the triggering signal. Such an encoding scheme includes one wherein the desired parameter to be transmitted is determined by the number of cycles of the triggering signals sent from the surface.

In the preferred embodiment transmission is accomplished during times in which the drill bit is not rotating. In one preferred embodiment operating with a carrier frequency of 24 Hz, the drill bit was stopped periodically for 2 minute transmission intervals. It was found that bit rates from one to 10 bits per second were attainable. With these bit rates it is possible in the 2 minute interval to transmit 120 to 1200 bits respectively. If, for example, the total number of bits stored for all sensor outputs is 300, three such intervals are more than sufficient for transmission of the entire 300 bits at the one bit per second rate. Only one 2 minute interval is required for bit rates of 2.5 bits per second or greater.

Transmission and reception is accomplished at well bottom station 140 through solenoidal antennas 142. Solenoidal antennas 142 have the same structure as those shown in FIGS. 2 and 3 in conjunction with the discussion below of repeater sections 126.

Repeater sections 126 including therein repeater stations 144 are spaced at predetermined intervals along the drilling pipe. Repeater sections 126 mate at each end with drilling pipe sections 124 and form an integral part of drilling pipe assembly 125. Drilling mud 130 flows through and around repeater sections 126 the same as through and around drilling pipe sections 124. The interval between repeater sections 126 will of course be determined by the electromagnetic characteristics of the formations encountered and the transmitting power and receiver sensitivity of each section. In the preferred embodiment, a spacing of 1 kilometer using a transmitter power of 100 watts has been found to be satisfactory for most values of the layer conductivity expected in the drilled stratification. The total number of repeater stations used will of course depend upon the overall depth of the well, only one repeater section 126 being shown in FIG. 1 for clarity.

Repeater section 126 performs three basic functions. First, it receives and amplifies the signals transmitted from the station next below it whether that station be another repeater station 144 or well bottom station 140. Secondly, the received and amplified signal is delayed by one or more bit period times to insure against regeneration or oscillation between repeater sections. Thirdly, repeater section 126 retransmits the received, amplified and delayed signal to the next station above.

The signals reaching the surface layer 102 are intercepted by surface station antenna 152 and coupled therefrom to surface station 150. At surface station 150 the received signals are demodulated and converted to a preferred form for further processing. Surface station 150 may include data storage and computer circuitry for performing calculations upon the received and demodulated signals. Of course, surface station 150 can include data storage circuitry such as a digital magnetic tape recorder so that the received data may be recorded and transported elsewhere for further processing.

Figure 2:
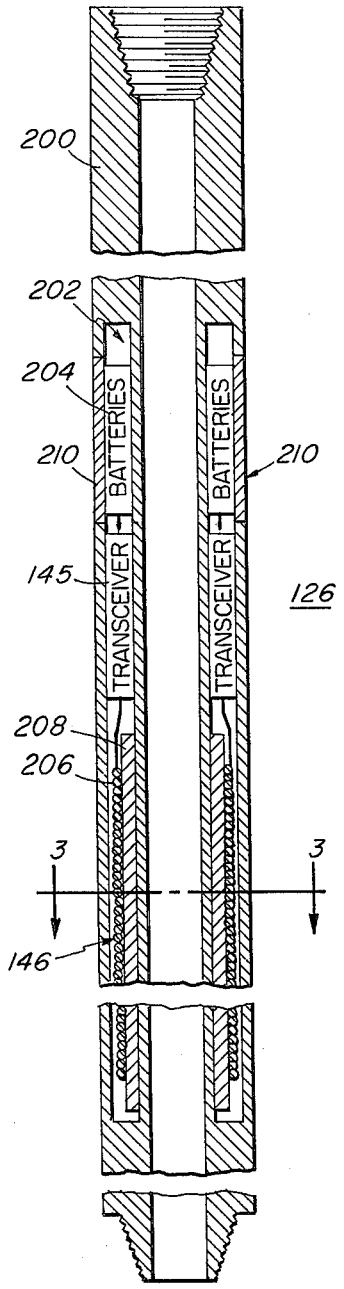
FIG. 2 is a cross-sectional view of a repeater section.
Figure 3:
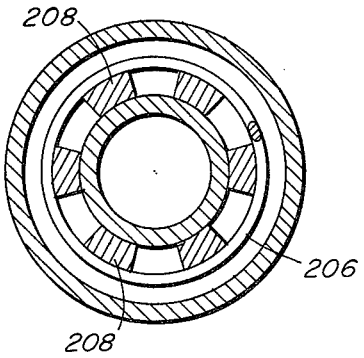
FIG. 3 is a cross-sectional view taken along the drill pipe section of FIG. 3 showing the preferred mounting of the antennas.

In FIG. 2 is shown a cross sectional view of a repeater section 126. Repeater section 126 is constructed of high strength steel casing 200 including therein cavity 202 which contains repeater station 144. Repeater section 144 includes three major components: solenoid antenna 146, transceiver 145 and batteries 204. Access cover 210 is provided on the outer surface of casing 200 above batteries 204 to permit access to and replacement of batteries 204. The type of steel used and the wall thicknesses employed around cavity 202 are chosen so that the overall mechanical strength of repeater section 126 will be the same as its adjacent sections of drilling pipe 124. This may result in some reduction of internal and external spaces available for flow of drilling mud. However, since the reduction will be modest and since the repeater stations are spaced as far apart as 1 kilometer or more, the total added resistance to the flow of drilling mud by the addition of repeater sections 126 will be minimal.

Antenna 146 is constructed of a number of parallel long high permeability rods around which is wrapped a number of turns of copper wire. In the preferred embodiment shown in cross-sectional view of FIG. 3, six of these rods are used although in practice any number could be employed. In the preferred embodiment, each rod is approximately 1 inch thick, 2 inches in width, and 20 feet in length. Winding 206 is coupled at each end to transceiver 145.

Figure 5:
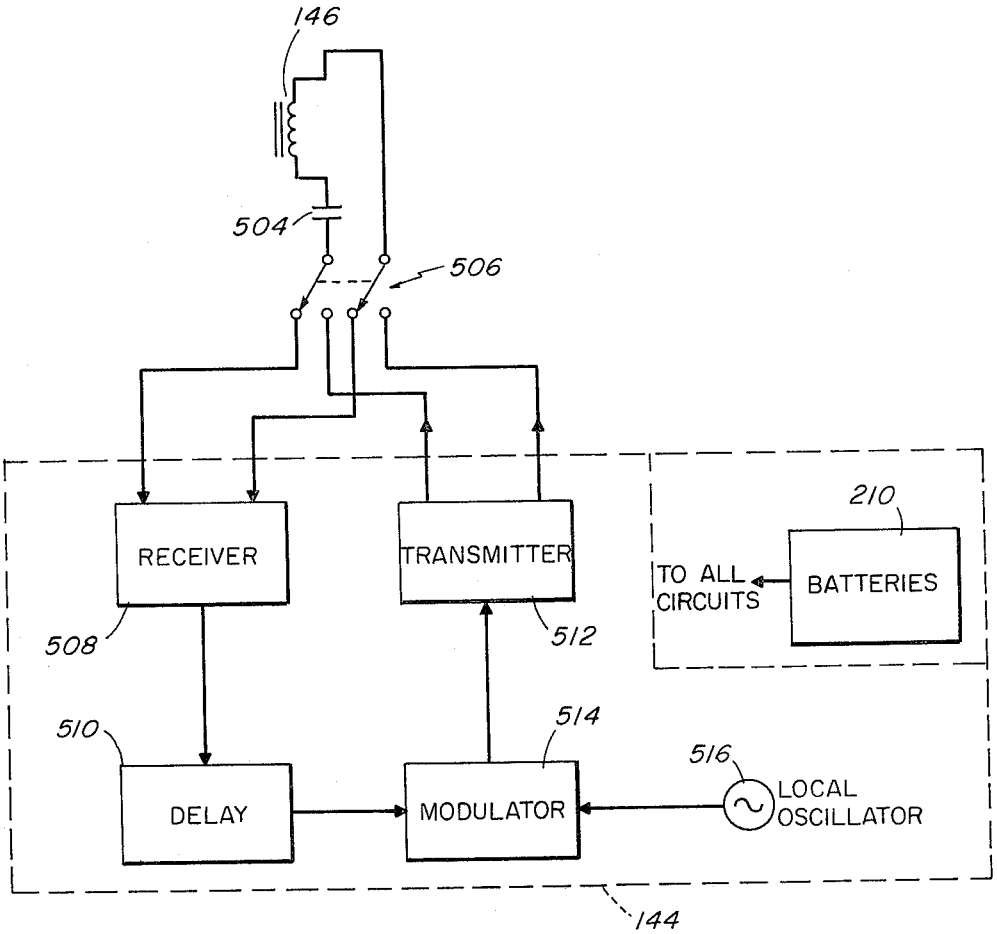
FIG. 5 is a block diagram of a repeater station.

In FIG. 5 is shown a block diagram of a preferred version of transceiver 144. Antenna 146 is connected in series with capacitor 504, the combination resonating at the chosen transmitting and receiving frequency of the system. During periods of reception, antenna 146 and resonating capacitor 504 are coupled through double-pole double-throw switch 506 to receiver 508. In a simple embodiment, receiver 508 amplifies the signal on its input leads and couples the amplified signal to delay circuit 510. However, in the preferred embodiment, receiver 508 first amplifies the signal then demodulates it to its original digital form and assembles the bits to a complete message. The assembled message is then digitally "recognized" by comparison with a number of stored pre-coded messages, there being one such message for every possible message transmitted. Of course, any number of different "recognition" schemes can be used, depending upon the expected quality of the intercepted signals and the required overall reliability of message transmission from well bottom to surface.

In any case, the output of receiver 508 is delayed by delay circuit 510 to prevent regeneration or oscillation between repeater stations 144 or well bottom station 128 or surface station 150. The delayed output modulates the signal from local oscillator 516 at modulator 514. In the preferred embodiment, local oscillator 516 operates at the same frequency as each of the other repeater stations 144 and well bottom station 140. One advantage in operating each section at the same transmitting frequency is that identical repeater sections can be used along the oil well. Adjustments and frequency changes need not be made for each individual section. However, it is possible to construct a system in accordance with the present invention using different frequencies at each station. In that case, it is necessary to provide input filtering or mixing before each receiver 508 and to tune the receiver to the frequency of the signal transmitted from the section next below. If differing frequencies are used among repeater stations, a delay circuit need not be used since there will then be no regeneration between repeater sections. However care must be exerted in installing the repeaters in the drilling string by observing the right sequence. In another embodiment, two different operating frequencies are used, the frequency being alternated from one repeater section to the next. A delay circuit need not be used if the spacing between repeater sections in the latter case is sufficient to prevent the signal from a repeater section from reaching the second repeater section above or below it which is operating at the same frequency.

Transmitter 512 amplifies the modulated signal from modulator 514. During transmission times switch 506 couples antenna 146 to the output terminals of transmitter 512.

Batteries 210 supply operating power to all circuits within repeater station 144. Batteries 210 are preferably of the lithium-organic compound type although any battery type capable of supplying sufficient power over the required time period of the temperature encountered in the oil well will suffice as well. Batteries 210 may be tested and replaced if necessary each time the oil well drilling pipe is removed from the well to change the drilling bit.

Figure 4:
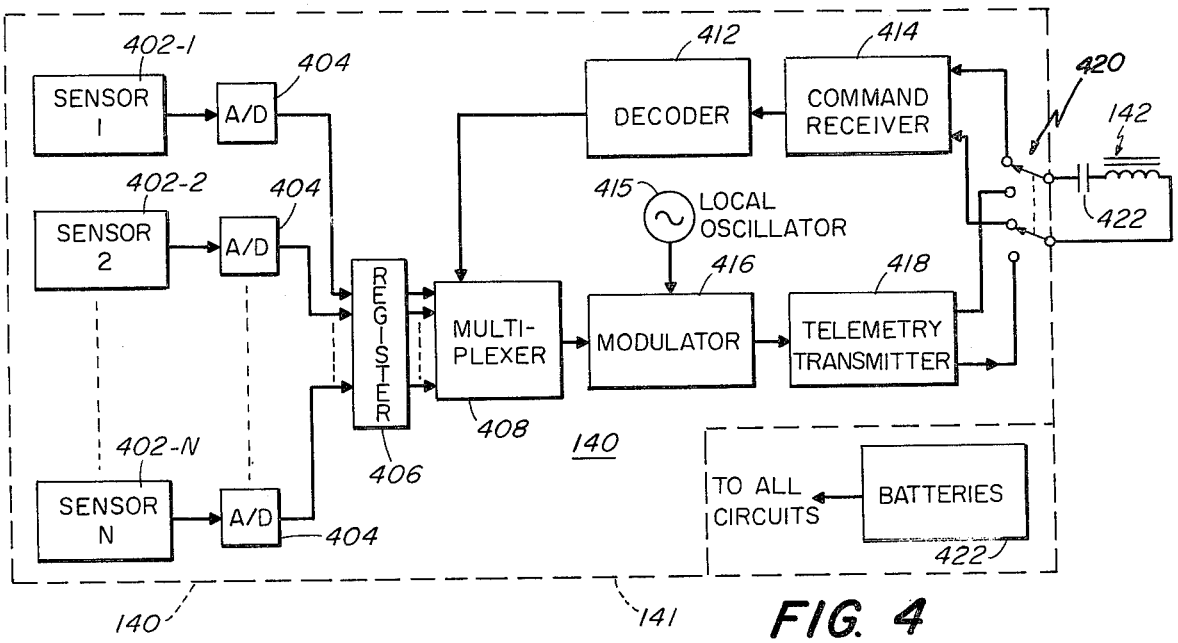
FIG. 4 is a block diagram of the well bottom telemetry station.

In FIG. 4 is shown a block diagram of a preferred embodiment of the electronics portion of well bottom section 128. Sensors 402-1 through 402-N are provided one for each desired parameter set forth above. These parameters are sensed during full rotation of the drilling string. Analog-to-digital converters 404 are coupled to each output of sensors 402-1 to 402-N. The analog to digital conversion is carried out to as many binary bits as necessary to obtain the desired measurement accuracy of the relevant parameters. The digitized measurements are stored in digital storage register 406 prior to transmission.

While awaiting and during reception of a triggering signal double-pole double-throw switch 420 couples antenna 142 and series resonating capacitor 422 to the input terminals of receiver 414. As in the case of the repeater section, the series combination of resonating capacitor 422 and antenna 142 resonates at the predetermined operating frequency of the system. Receiver 414 detects and amplifies the triggering signal sent from the surface. The demodulated output of receiver 414 causes decoder 412 to begin advancing.

Multiplexer 408 responds to the count input by coupling a corresponding input bit line to its output. Each digitized parameter measurement corresponds to a predetermined sequence of adjacent counts. If the triggering signal is encoded to indicate which parameter measurement is to be transmitted, decoder 412 produces as its output a binary number corresponding to the first bit of the desired measurement. A count sequence is commenced with this binary number which continues until the last bit of the measurement has been transmitted. Multiplexer 408 operates in response to the output of decoder 412 to couple the digital outputs of register 406 to the input of modulator 416. Each digitized measurement is coupled in sequence one bit at a time. An identifying code may be attached to and transmitted before the transmission of each digitized message.

Local oscillator 415, modulator 416, and transmitter 418 operate the same as the equivalent circuitry of repeater section 126 as shown in FIG. 5. During transmission times the output terminals of transmitter 418 are coupled through switch 420 to resonating capacitor 422 and antenna 142. Transmission of the telemetry data takes place during the drilling pauses.

In one embodiment, a repeater station remains in the receiving mode while the station next below is transmitting one or more message bits. That repeater station switches to the transmitting mode as soon as the station next below has completed transmission of the message bits and retransmits the same message bits before the station next below transmits further message bits in the sequence.

The packaging of well bottom repeater section circuitry is the same or similar to that done for repeater section 126. The same type of pipe section with cavity provided may be used to package repeater section 128. The same antenna construction may be used. Of course, other types of well bottom transmission schemes could be used as well, the circuitry of the block diagram of FIG. 4 being by way of illustration only. For example, each measured parameter could be transmitted separately upon a different frequency. Instead of batteries, an internal power generator may be used which derives its operating force from the flow of drilling mud.

Although preferred embodiments of the invention have been described numerous modifications and alterations thereto would be apparent to one skilled in the art without departing from the spirit and scope of the present invention.

What is claimed is:

1. A system for telemetry of parameter measurements from the bottom of an oil well to the surface of the earth comprising in combination:

means for measuring physical parameters in an oil well bore hole;

means for digitizing mesurements of said physical parameters;

means for transmitting said digitized measurements upon a carrier signal, said transmitting means comprising a first solenoidal antenna;

one or more means for receiving signals transmitted by said transmitting means, said receiving means being located between said oil well bottom and said surface;

one or more means for retransmitting received signals, one of said retransmitting means being coupled to each of said receiving means;

one or more second solenoidal antennas, one of said second solenoidal antennas being coupled to said receiving and retransmitting means;

means for receiving retransmitted signals at the surface of the earth; and said signals transmitted by said transmitting means and said retransmitted signals comprising electromagnetic radiation fields having a frequency below 30 Hz.

2. The combination of claim 1 further comprising means for delaying received signals and wherein each of said retransmitting means retransmits said signals at the same frequency at which they were originally transmitted.

3. The combination of claim 2 further comprising means for initiating transmission of said parameters, said initiating means being located in the region of said surface of the earth.

4. The combination of claim 3 wherein said initiating means transmits a triggering signal from said surface to said oil well bottom.

5. The combination of claim 4 wherein said triggering signal is encoded to initiate transmission of a predetermined one or more of said parameters.

6. The combination of claim 1 wherein said first and second solenoidal antennas each comprise:

a plurality of high permeability rods; and a plurality of turns of wire wrapped around all of said rods.

7. The combination of claim 1 wherein said transmitting means comprises:

means for phase shift modulating said carrier signal.

8. In combination:

first means for transmitting a first signal comprising electromagnetic radiation fields having a frequency below 30 Hz, said first transmitting means being located in the region of the surface of the earth;

means for receiving said first signal, said receiving means being located below the surface of the earth in the region of a bore hole, said receiving means comprising a solenoidal antenna;

said first transmitting means comprising a loop antenna having a diameter substantially greater than the diameter of said bore hole; and means for activating actuating means in response to the received first signal.

9. The combination of claim 8 wherein said first signal is digitally encoded.

10. The combination of claim 9 wherein said actuating means comprises second means for initiating transmission of a second signal from said region of said bore hole.

11. The combination of claim 10 wherein said second signal is encoded to represent predetermined parameters.

12. A method for telemetering measurements from the bottom of an oil well to the surface of the earth comprising the steps of:

measuring physical parameters in an oil well bore hole;

digitizing measurements of said physical parameters transmitting the digitized measurements upon a carrier signal and with a first solenoidal antenna;

receiving the transmitted signals at one or more positions between said bottom of said oil well and said surface of the earth with a second solenoidal antenna;

retransmitting the received signals at said positions with said second solenoidal antenna; and receiving transmitted signals at said surface of the earth;

said transmitted signals and the retransmitted signals comprising electromagnetic radiation fields having a frequency below 30 Hz.

13. The method of claim 12 further comprising the steps of:

delaying the received signals at each of said locations prior to retransmitting said signals.

14. The method of claim 13 further comprising the step of:

initiating transmission of said parameters from the region of said surface of the earth.

15. The method of claim 13 wherein said step of initiating transmission comprises;

transmitting a digitally encoded signal.

16. The method of claim 15 wherein said digitally encoded signal initiates transmission of a predetermined one or more of said parameters.

* * * * *